US007029336B2

(12) United States Patent
Cox

(10) Patent No.: US 7,029,336 B2
(45) Date of Patent: Apr. 18, 2006

(54) SYSTEM AND METHOD FOR CONNECTING WIRING

(75) Inventor: Ned Cox, Gray, TN (US)

(73) Assignee: Siemens Energy & Automation, Inc., Alpharetta, GA (US)

( * ) Notice: Subject to any disclaimer, the term of this patent is extended or adjusted under 35 U.S.C. 154(b) by 0 days.

(21) Appl. No.: 10/855,822

(22) Filed: May 27, 2004

(65) Prior Publication Data

US 2004/0242049 A1 Dec. 2, 2004

Related U.S. Application Data

(60) Provisional application No. 60/473,913, filed on May 28, 2003.

(51) Int. Cl.
*H01R 9/22* (2006.01)

(52) U.S. Cl. ..... 439/709; 439/811

(58) Field of Classification Search ..... 439/709, 439/712, 798, 813, 814, 810, 811
See application file for complete search history.

(56) References Cited

U.S. PATENT DOCUMENTS 2,991,440 A * 7/1961 Kulka ..... 239/17
3,930,706 A * 1/1976 Obuch et al. ..... 439/249
4,090,762 A 5/1978 Hoffman
4,175,822 A 11/1979 Debaigt
4,640,571 A 2/1987 Walter
4,872,855 A 10/1989 Norden
5,599,211 A 2/1997 Kurahashi

FOREIGN PATENT DOCUMENTS

EP 295 17 261 U1 1/1997

OTHER PUBLICATIONS

Patent Cooperation Treaty, mailed Feb. 11, 2004 PCT/US2004/016704 (Written Opinion of the International Searching Authority) 5 pages.
PCT International Search Report, (3 pages) mailed Feb. 11, 2004 PCT/US2004/016704.

* cited by examiner

*Primary Examiner*—Javaid H. Nasri

(57) ABSTRACT

Certain exemplary embodiments comprise a system comprising: a connector for electrically coupling a plurality of wires to a printed circuit board, a termination end of each of the plurality of wires stripped of insulation, said connector comprising: a housing defining a plurality of a co-planar plurality of openings; and a plurality of clamps, each of the plurality of clamps adapted to receive the stripped termination end of at least one of the plurality of wires via the corresponding opening; wherein said plurality of screw-actuated clamps are disposed in an alternating proximal-distal relationship with respect to said co-planar plurality of openings.

22 Claims, 5 Drawing Sheets

SYSTEM AND METHOD FOR CONNECTING WIRING

CROSS-REFERENCES TO RELATED APPLICATIONS

This application claims priority to, and incorporates by reference herein in its entirety, pending U.S. Provisional Patent Application Ser. No. 60/473,913, filed 28 May 2003.

BACKGROUND

U.S. Pat. No. 5,599,211 (Kurahashi), which is incorporated herein by reference, allegedly recites a "fixed terminal hingably supports a movable terminal of a terminal device. A terminal screw passes through a hole in the fixed terminal to engage a threaded hole in the movable terminal. A captivating device prevents the terminal screw from being withdrawn from the fixed terminal. The terminal screw, when tightened, clamps an element to be connected between the fixed and movable terminals. The captivating device, when the terminal screw is loosened, urges the movable terminal away from the fixed terminal to separate the two, thereby positively releasing the element connected therebetween." See Abstract.

U.S. Pat. No. 4,090,762 (Hoffman), which is incorporated herein by reference, allegedly recites a "terminal connection which will accept electrical conductors of various sizes and provides oxide breaking, spring loading, and conductor confining and bundling features. A tab or finger on one of the terminal elements presses the conductor regardless of its size toward the other terminal element, and oxide breaking edges on one of the elements break oxide coatings on the conductor while the tab or finger both confines the conductor and forces it toward a mechanical operator such as a screw. Forcing the conductor toward the screw reduces offset loading and permits additional oxide breaking by scraping the conductor with the screw as the screw is rotated to tighten the terminal. In the case of a stranded conductor, the bundling obtained by forcing the conductor toward the screw assures good interstrand electrical contact, so that the electrical resistance at the connection is not significantly different from the resistance of a corresponding solid conductor. In several embodiments, the tab or finger provides the spring loading or spring follow required to maintain good electrical and mechanical characteristics of the connection. In some embodiments, a struck-out leg provides spring loading and the biting action for oxide breaking." See Abstract.

SUMMARY

Certain exemplary embodiments comprise a system comprising: a connector for electrically coupling a plurality of wires to a printed circuit board, a termination end of each of the plurality of wires stripped of insulation, said connector comprising: a housing defining a plurality of a co-planar plurality of openings; and a plurality of clamps, each of the plurality of clamps adapted to receive the stripped termination end of at least one of the plurality of wires via the corresponding opening; wherein said plurality of screw-actuated clamps are disposed in an alternating proximal-distal relationship with respect to said co-planar plurality of openings.

BRIEF DESCRIPTION OF THE DRAWINGS

A wide variety of potential embodiments will be more readily understood through the following detailed description, with reference to the accompanying drawings in which.

DEFINITIONS

Figure 1:
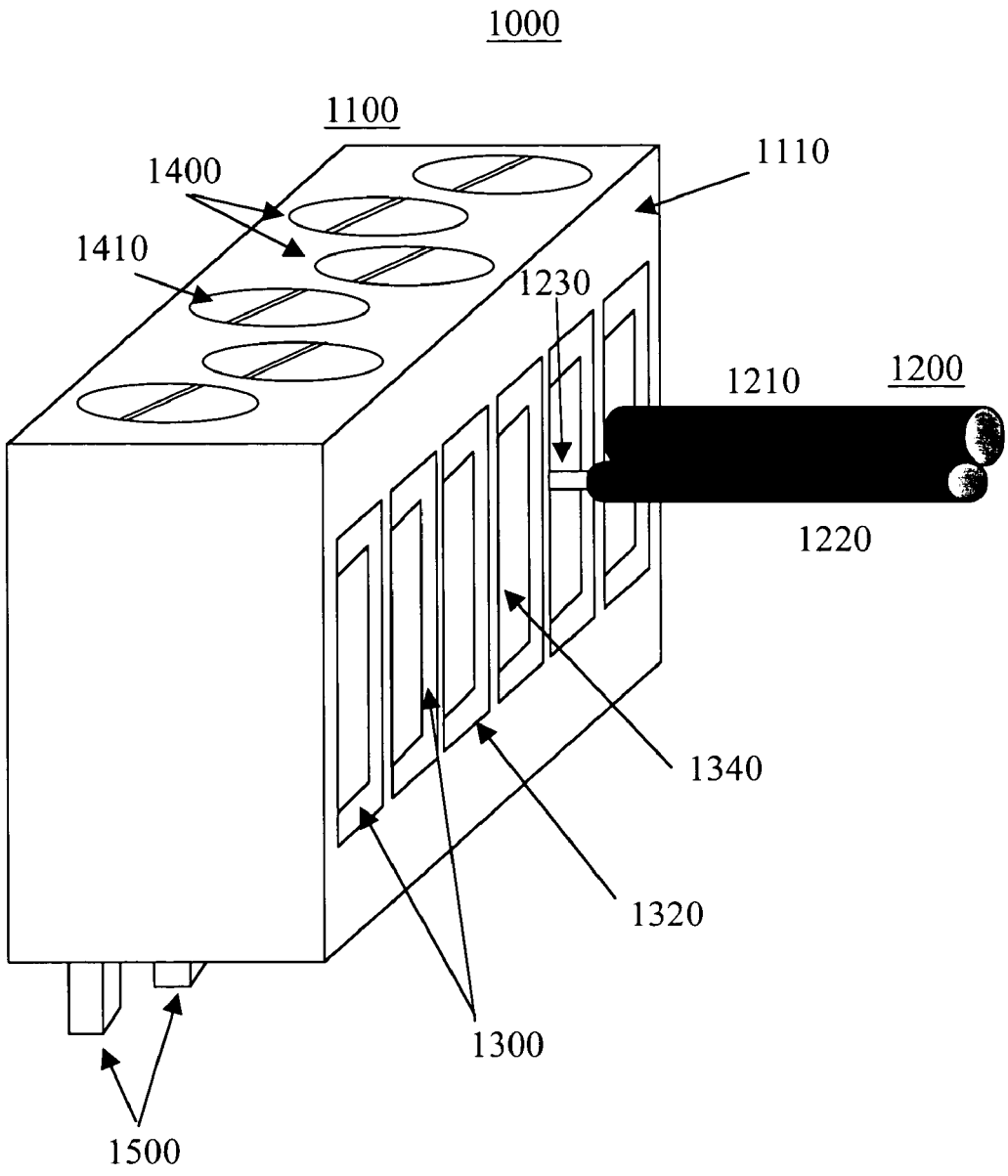
FIG. 1 is a perspective view of an exemplary embodiment of a system 1000.

When the following terms are used herein, the accompanying definitions apply:

- alternating proximal-distal relationship—a staggered pattern comprising one that is located toward the front, followed by another that is located toward the back, and then repeating.
- attaching—the process of fastening, securing, and/or joining.
- axially restrained screw—a screw that does not substantially advance or retreat along the screw's longitudinal axis when the screw is rotated.
- cage—a partially open box or enclosure.
- clamp—n. a device used to join, grip, support, and/or compress. v. to join, grip, support, and/or compress.
- comprised—included in; a part of.
- comprises—includes, but is not limited to.
- comprising—including but not limited to.
- co-planar—lying or occurring in the same plane.
- couple—to join, connect, and/or link two things together.
- electrical path—a conductive circuit.
- firmware—machine-readable instructions that are stored in a read-only memory (ROM). ROM's can comprise PROMs and EPROMs.
- freely accessible—able to be reached without substantial impediment or interference.
- gage—the American Wire Gage measurement of wire diameter.
- haptic—both the human sense of kinesthetic movement and the human sense of touch. Among the many potential haptic experiences are numerous sensations, body-positional differences in sensations, and time-based changes in sensations that are perceived at least partially in non-visual, non-audible, and non-olfactory manners, including the experiences of tactile touch (being touched), active touch, grasping, pressure, friction, traction, slip, stretch, force, torque, impact, puncture, vibration, motion, acceleration, jerk, pulse, orientation, limb position, gravity, texture, gap, recess, viscosity, pain, itch, moisture, temperature, thermal conductivity, and thermal capacity.
- housing—an enclosing, covering, protecting, and/or supporting frame, box, and/or chassis.
- I/O device—any sensory-oriented input and/or output device, such as an audio, visual, haptic, olfactory, and/or taste-oriented device, including, for example, a monitor, display, projector, overhead display, keyboard, keypad, mouse, trackball, joystick, gamepad, wheel, touchpad, touch panel, pointing device, microphone, speaker, video camera, camera, scanner, printer, haptic device, vibrator, tactile simulator, and/or tactile pad, potentially including a port to which an I/O device can be attached or connected.

information device—any device capable of processing information, such as any general purpose and/or special purpose computer, such as a personal computer, workstation, server, minicomputer, mainframe, supercomputer, computer terminal, laptop, wearable computer, and/or Personal Digital Assistant (PDA), mobile terminal, Bluetooth device, communicator, "smart" phone (such as a Handspring Treo-like device), messaging service (e.g., Blackberry) receiver, pager, facsimile, cellular telephone, a traditional telephone, telephonic device, a programmed microprocessor or microcontroller and/or peripheral integrated circuit elements, an ASIC or other integrated circuit, a hardware electronic logic circuit such as a discrete element circuit, and/or a programmable logic device such as a PLD, PLA, FPGA, or PAL, or the like, etc. In general any device on which resides a finite state machine capable of implementing at least a portion of a method, structure, and/or or graphical user interface described herein may be used as an information device. An information device can include well-known components such as one or more network interfaces, one or more processors, one or more memories containing instructions, and/or one or more input/output (I/O) devices, one or more user interfaces, etc.

Internet—an interconnected global collection of networks that connect information devices.

machine-readable medium—a physical structure from which a machine can obtain data and/or information. Examples include memory devices, punch cards, etc.

memory device—any device capable of storing analog or digital information, for example, a non-volatile memory, volatile memory, Random Access Memory, RAM, Read Only Memory, ROM, flash memory, magnetic media, a hard disk, a floppy disk, a magnetic tape, an optical media, an optical disk, a compact disk, a CD, a digital versatile disk, a DVD, and/or a raid array, etc. The memory device can be coupled to a processor and can store instructions adapted to be executed by the processor according to an embodiment disclosed herein.

network—a communicatively coupled plurality of communication devices.

network interface—any device, system, or subsystem capable of coupling an information device to a network. For example, a network interface can be a telephone, cellular phone, cellular modem, telephone data modem, fax modem, wireless transceiver, Ethernet card, cable modem, digital subscriber line interface, bridge, hub, router, or other similar device.

non-destructively—of, relating to, or being a process that does not result in damage to the subject material and/or product.

plurality—the state of being plural and/or more than one.

printed circuit board—a thin substantially planar board to which electronic components are fixed, typically by solder. Component leads and integrated circuit pins may pass through holes ("vias") in the board or they may be surface mounted, in which case no holes are required (although they may still be used to interconnect different layers of the board).

processor—a device for processing machine-readable instruction. A processor can be a central processing unit, a local processor, a remote processor, parallel processors, and/or distributed processors, etc. The processor can be a general-purpose microprocessor, such the Pentium III series of microprocessors manufactured by the Intel Corporation of Santa Clara, Calif. In another embodiment, the processor can be an Application Specific Integrated Circuit (ASIC) or a Field Programmable Gate Array (FPGA) that has been designed to implement in its hardware and/or firmware at least a part of an embodiment disclosed herein.

programmable logic controller (PLC)—a device that follows programmed instructions to provide automated monitoring and/or control functions over a machine and/or process by evaluating a set of inputs. A PLC can be used to automate complex functions, for example, in machining, packaging, materials handling, and/or other applications. A PLC can be utilized to control an industrial process.

release—to free from something that binds, fastens, or holds back; to let go.

removably—to be able to move from a place or position occupied.

screw-actuated—to move something based on the rotation of a screw.

socket—an opening or a cavity into which an inserted part is designed to fit.

system—a collection of mechanisms, devices, and/or instructions, the collection designed to perform one or more specific functions.

transmit—to convey (force or energy) from one part of a mechanism to another.

user interface—any device for rendering information to a user and/or requesting information from the user. A user interface includes at least one of textual, graphical, audio, video, animation, and/or haptic elements. A textual element can be provided, for example, by a printer, monitor, display, projector, etc. A graphical element can be provided, for example, via a monitor, display, projector, and/or visual indication device, such as a light, flag, beacon, etc. An audio element can be provided, for example, via a speaker, microphone, and/or other sound generating and/or receiving device. A video element or animation element can be provided, for example, via a monitor, display, projector, and/or other visual device. A haptic element can be provided, for example, via a very low frequency speaker, vibrator, tactile stimulator, tactile pad, simulator, keyboard, keypad, mouse, trackball, joystick, gamepad, wheel, touchpad, touch panel, pointing device, and/or other haptic device, etc. A user interface can include one or more textual elements such as, for example, one or more letters, number, symbols, etc. A user interface can include one or more graphical elements such as, for example, an image, photograph, drawing, icon, window, title bar, panel, sheet, tab, drawer, matrix, table, form, calendar, outline view, frame, dialog box, static text, text box, list, pick list, pop-up list, pull-down list, menu, tool bar, dock, check box, radio button, hyperlink, browser, button, control, palette, preview panel, color wheel, dial, slider, scroll bar, cursor, status bar, stepper, and/or progress indicator, etc. A textual and/or graphical element can be used for selecting, programming, adjusting, changing, specifying, etc. an appearance, background color, background style, border style, border thickness, foreground color, font, font style, font size, alignment, line spacing, indent, maximum data length, validation, query, cursor type, pointer type, autosizing, position, and/or dimension, etc. A user interface can include one or more audio elements such as, for example, a volume control, pitch control, speed control, voice selector, and/or one or more elements for controlling audio play, speed, pause, fast forward, reverse, etc. A user interface can include one or more video elements such as, for example, elements controlling video play, speed, pause, fast forward, reverse, zoom-in, zoom-out, rotate, and/or tilt, etc. A user interface can include one or more animation elements such as, for example, elements controlling animation play, pause, fast forward, reverse, zoom-in, zoom-out, rotate, tilt, color, intensity, speed, frequency, appearance, etc. A user interface can include one or more haptic elements such as, for example, elements utilizing tactile stimulus, force, pressure, vibration, motion, displacement, temperature, etc.

DETAILED DESCRIPTION

Certain exemplary embodiments comprise a system comprising: a connector for electrically coupling a plurality of wires to a printed circuit board of a programmable logic controller, a termination end of each of the plurality of wires stripped of insulation, said connector comprising: a housing defining a plurality of a co-planar plurality of openings; and a plurality of clamps, each of which is adapted to receive the stripped termination end of at least one of the plurality of wires via the corresponding opening; wherein said plurality of screw-actuated clamps are disposed in an alternating proximal-distal relationship with respect to said co-planar plurality of openings.

Figure 2:
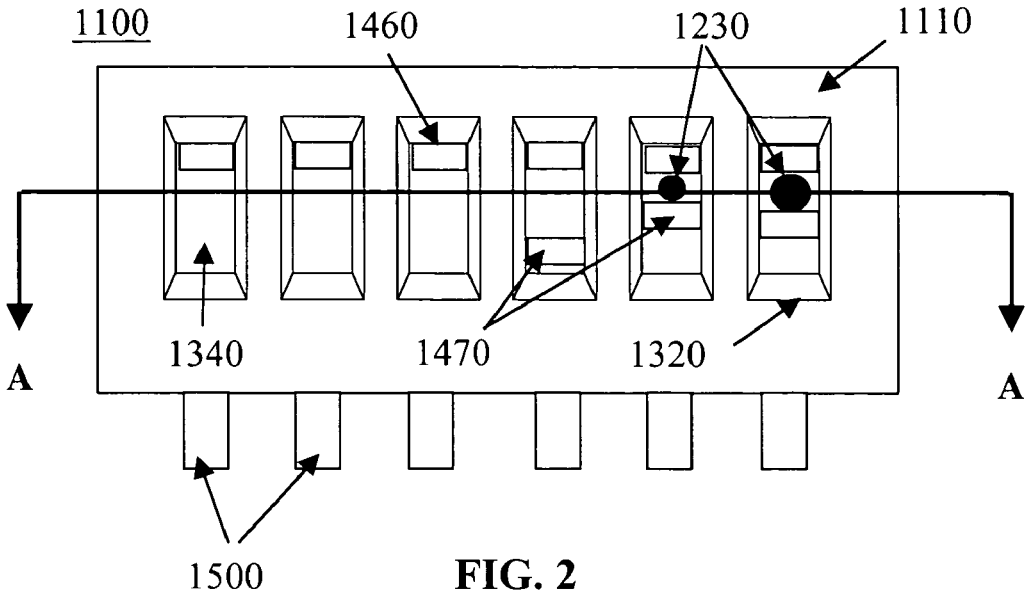
FIG. 2 is a front view of the exemplary embodiment of system 1000.
Figure 3:
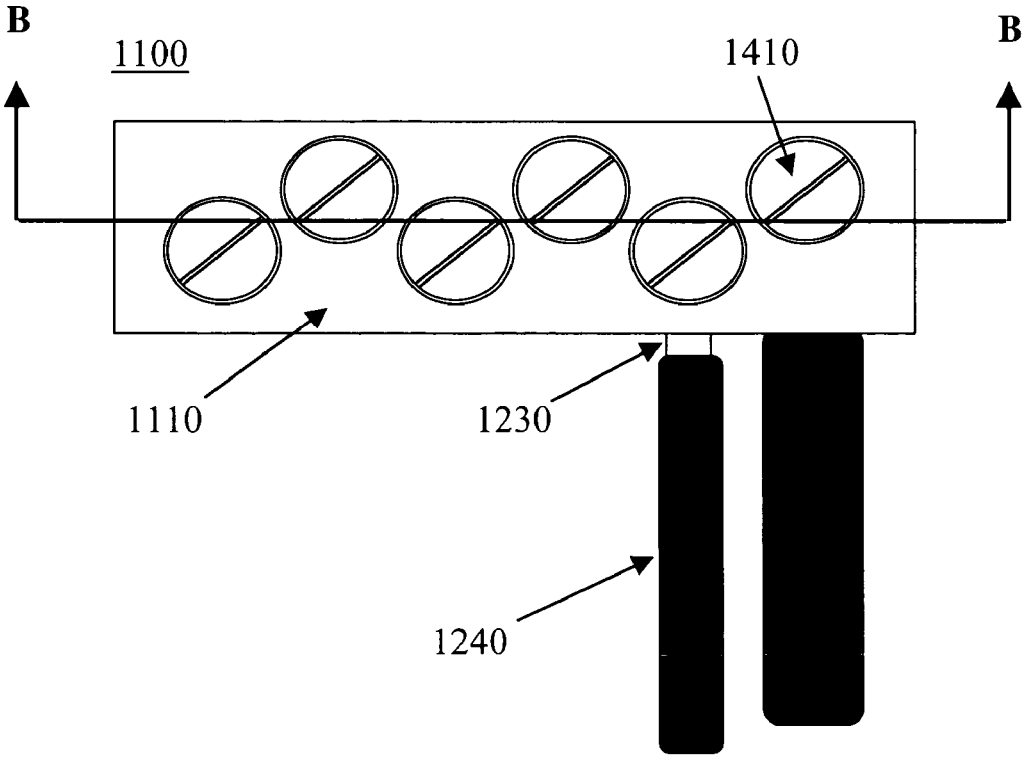
FIG. 3 is a top view of the exemplary embodiment of system 1000.

FIG. 1 is a perspective view, FIG. 2 is a front view, and FIG. 3 is a top view, of an exemplary embodiment of a system 1000, which can be used as a connector 1100 for electrically coupling a plurality of wires 1200 to, for example, an information device, a network interface card, and/or a printed circuit board (PCB), such as a PCB of a programmable logic controller (PLC) and/or any other type of information device. Wires 1200 can convey input signals, output signals, control signals, power, and/or grounding. Wires 1200 can be any size, such as for example, from about 22 gage to about 14 gage.

Connector 1100 can comprise a housing 1110 that defines any number of cages 1300. Each cage 1300 can define a cage opening 1320 at an entrance to a tapered channel 1340 that leads within cage 1300. All of the cage openings 1320 can be co-planar, that is, all of cage openings 1320 can be aligned with a front plane defined by housing 1110 and/or connector 1100, and/or a plane slightly recessed from that front plane.

Disposed substantially within, and/or comprised by, each cage 1300 can be a wire clamping device 1400. In certain exemplary embodiments, the wire clamping device can be implemented as a screw-actuated clamp, which can comprise a rotatable but non-linearly progressing screw head 1410 that is coupled to a rotatable but non-linearly progressing screw shaft (shown in FIG. 5). Screw-actuated clamp 1400 can also comprise a pair of clamping jaws 1460, 1470, at least one of which can be moved by the rotation of screw head 1410.

One or more wires 1210, 1220 can be coupled to connector 1100 via one or more screw-actuated clamps 1400, such as via a releasable clamping action of screw-actuated clamps 1400. For example, a bare end 1230 of wire 1210, such as an end of wire that has been stripped of insulation 1240, can be terminated by electrical contact within cage 1300, such as electrical contact with one or more jaws of screw-actuated clamp 1400. In certain embodiments, multiple wires can be terminated within a single clamp 1400. For example, a single clamp 1400 can be dimensioned to receive and/or terminate two 14 gage wires.

An electrically conductive path can be formed from at least a portion of screw-actuated clamp 1400, such as clamping jaw 1470, to a corresponding pin 1500 coupled thereto. A substantially longitudinally parallel set of pins 1500 can be inserted into holes located through the PCB and soldered to the PCB. Alternatively, pins 1500 can be inserted into a receiving socket mounted on the PCB, or can be integral to the socket and insertable into connector 1100, thereby non-destructively removably connecting connector 1100 and/or wires to the PCB. In either case, the connection of wired connector 1100 to PCB can form an electrically conductive path from the wires to the PCB. The portion of this electrically conductive path that flows through connector 1100 can repeatedly and/or sustainably carry and/or accommodate up to approximately 300 volts and/or up to approximately 10 amps.

As shown, screw heads 1410 can be arranged and/or disposed in an alternating proximal-distal relationship with respect to cage openings 1320 and/or a front surface. That is, a first, third, . . . etc., screw head can be disposed relatively closer to the front surface and/or front plane defined by housing 1110 and/or connector 1100, and a second, fourth, . . . etc., screw head can be disposed relatively further from the front surface and/or front plane defined by housing 1110 and/or connector 1100, or vice versa. Before and after receiving wires in their associated cages, screw heads 1410 can be freely accessible to a screwdriver, such as a flat-bladed and/or Phillips-head screwdriver.

Figure 4:
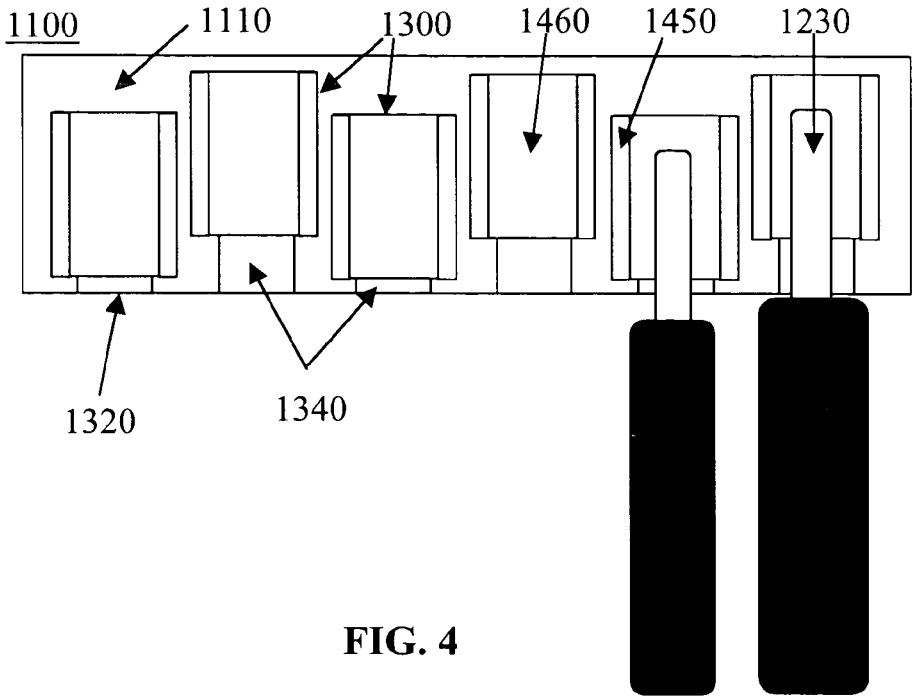
FIG. 4 is a cross-sectional view taken at section A—A of FIG. 2.
Figure 5:
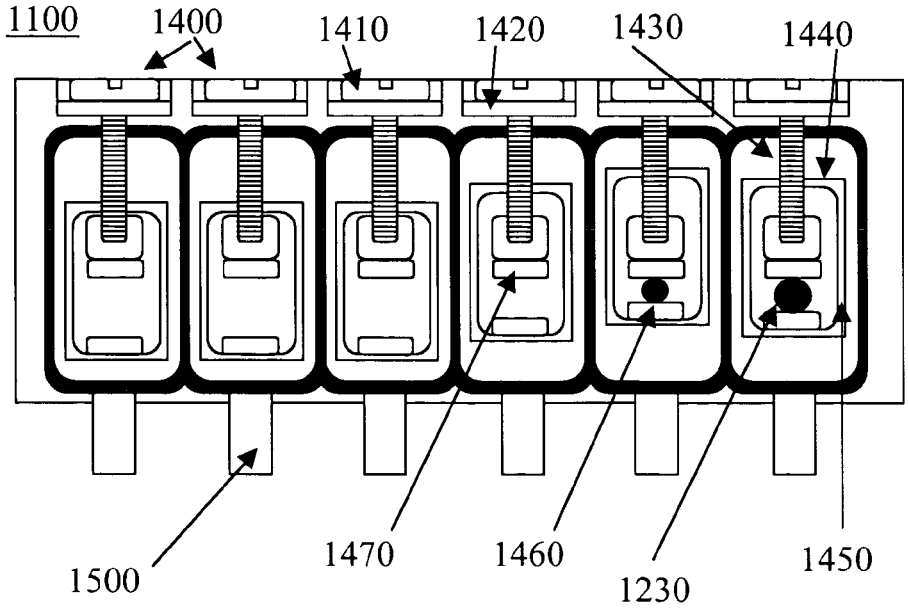
FIG. 5 is a cross-sectional view taken at section B—B of FIG. 3.

FIG. 4 is a cross-sectional view taken at section A—A of FIG. 2, and FIG. 5 is a cross-sectional view taken at section B—B of FIG. 3. As shown, a bare end 1230 of each of wires 1210 and 1220, each of which penetrates cage opening 1320 and resides within channel 1340 that leads within cage 1300.

Screw-actuated clamp 1400 can comprise a screw head 1410, a screw-restraining collar 1420, an axially-restrained screw shaft 1430, a thread follower 1440, one or more sidewalls 1450, a movable clamping jaw 1460, a stationary clamping jaw 1470 opposingly disposed to movable clamping jaw 1460. Collar 1420 and/or a similar mechanism can substantially prevent and/or resist movement of screw head 1410 and/or screw shaft 1430 in a direction parallel to the longitudinal axis of screw shaft 1430 when screw head 1410 and/or screw shaft 1430 is rotated.

Thread follower 1440 can be threaded to substantially match and/or mate with threads of screw shaft 1430. Thread follower 1440 can convert rotation of screw shaft 1430 of screw-actuated clamp 1400 to a linear, up-and-down and/or back-and-forth motion of sidewalls 1450.

Coupled to sidewalls 1450 can be a movable clamping jaw 1460, which can track the movement of sidewalls 1450. Clamping jaw 1460 and/or clamping jaw 1470 can have a ridged and/or serrated surface to facilitate improved grasping of wire ends 1230.

Screw head 1410, which can be roughly 3.8 millimeters in diameter, can repeatedly and/or sustainably transmit an applied torque of at least about 5 inch-pounds to and/or axially restrained screw shaft 1430, and via interaction with thread follower 1440, that torque can be converted to a force that can move sidewalls 1450, movable clamping jaw 1460, and/or wire ends 1230. When clamped between movable clamping jaw 1460 and stationary clamping jaw 1470, wire ends 1230 can be electrically conductively coupled to pins 1500.

By staggering the locations of screw heads 1410, cages 1300, and/or wire ends 1230, a desired separation distance and/or isolation between screw heads 1410, cages 1300, and/or wire ends 1230 can be maintained. For example, connector 1100 can provide for a pitch and/or center-to-center distance between wire ends 1230, and/or between wire ends 1230 and screw heads 1410, of approximately 4 millimeters. With respect to screw heads 1410 and/or stationary clamping jaws 1470, a single row and/or layer of wires 1200 can be formed via use of connector 1100, thereby potentially facilitating a view of and/or access to connector 1100 and/or an installation, modification, and/or removal of connector 1100 from the PCB and/or one or more wire ends 1230 from connector 1100.

Figure 6:
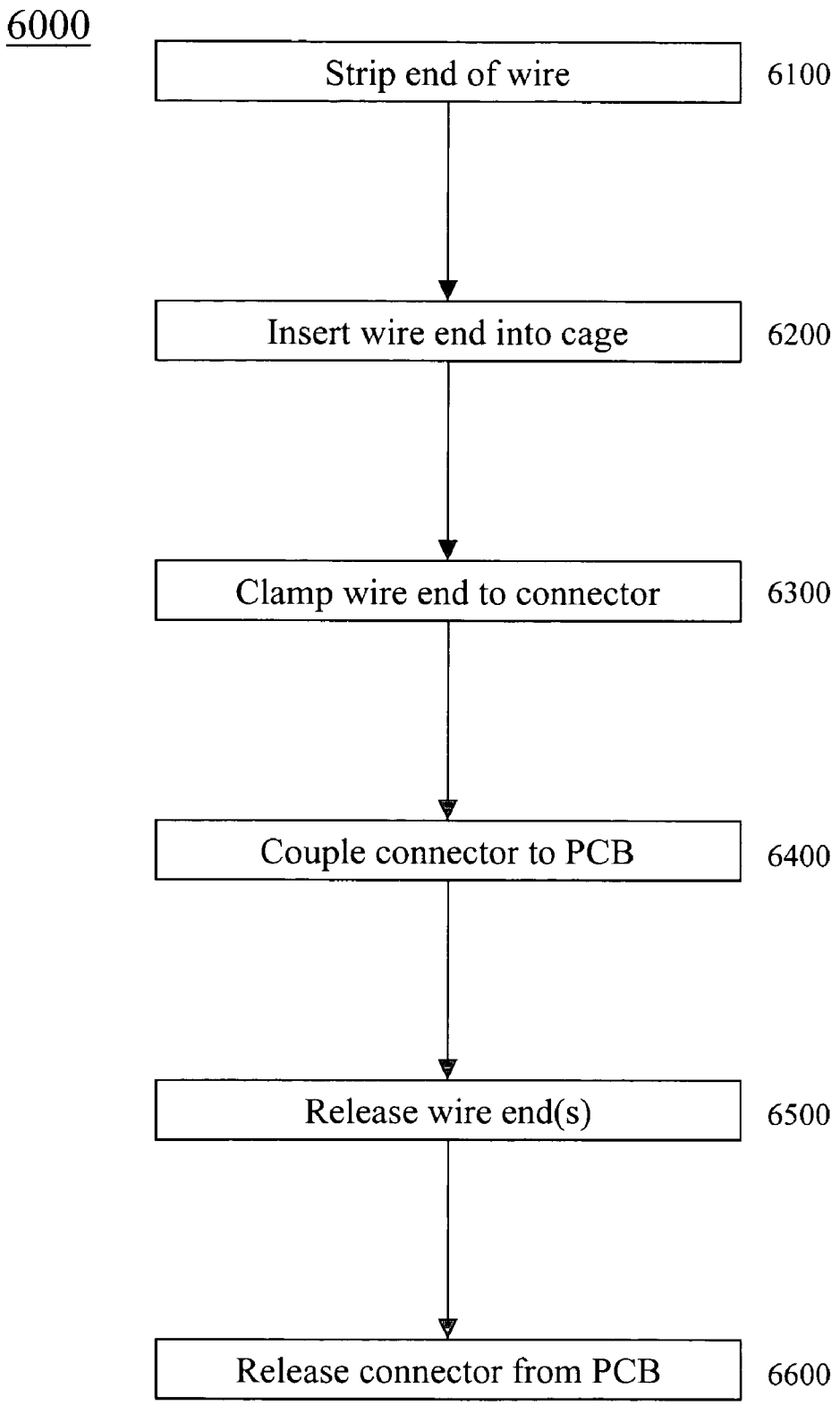
FIG. 6 is a flowchart of an exemplary method 6000.

FIG. 6 is a flowchart of an exemplary method 6000 for electrically coupling one or more wires to a PCB. At activity 6100, a termination end of a wire can be stripped of insulation. At activity 6200, the bare termination end of one or more wires can be inserted through a cage opening and/or into a cage of a housing of a connector. At activity 6300, a screw-actuated clamps can be utilized to clamp the termination end of the one or more wires. At activity 6400, the connector can be coupled to the PCB. At activity 6500, one or more of the termination ends can be released from the corresponding clamp. At activity 6600, the connector can be de-coupled and/or released, perhaps nondestructively, from the PCB.

Figure 7:
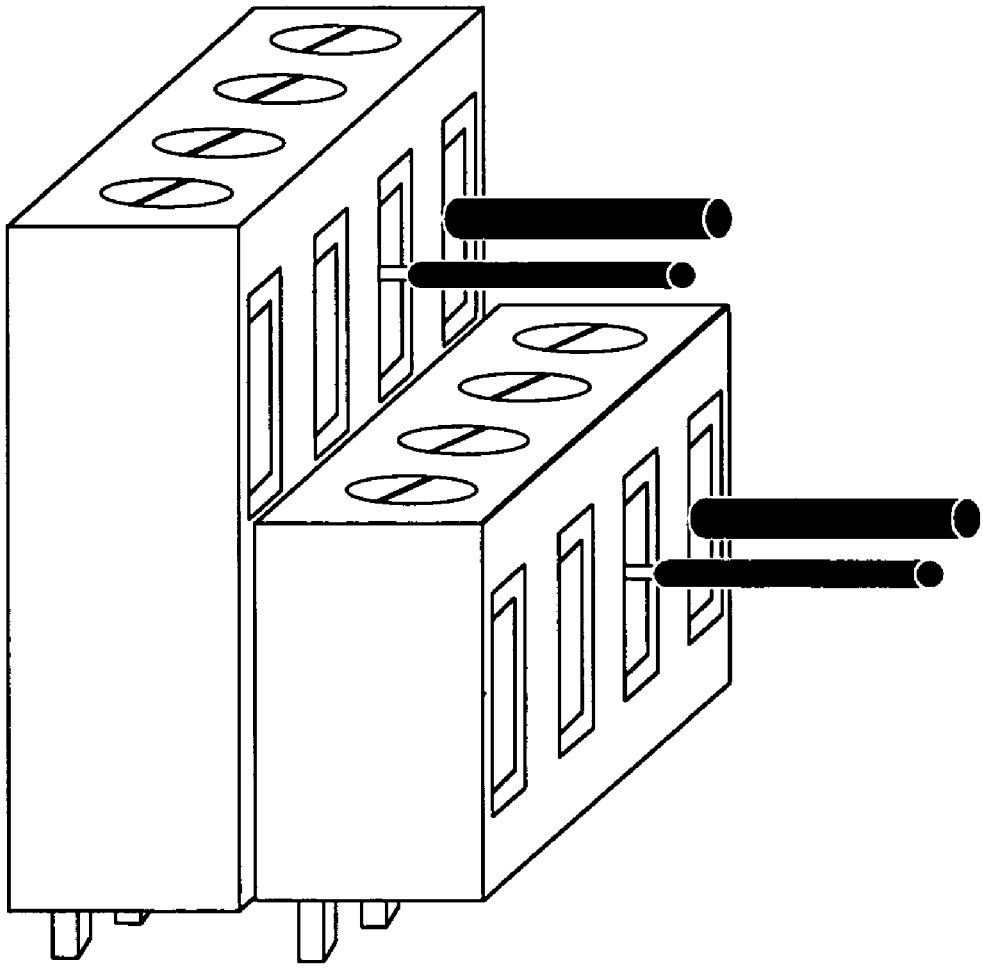
FIG. 7 PRIOR ART
FIG. 7 is a perspective view of an exemplary embodiment of a known system.

FIG. 7 is a perspective view of an exemplary embodiment of a known connector system that comprises a "double stack" of screw-actuated clamps. One row of clamps and associated cages is provided at a lower level, and a second row of clamps and associated cages is provided at an upper level. To couple the same number of wires to a PCB as can be coupled using system 1000 of FIG. 2, the double-stack approach requires at least a "taller" and "deeper" connector, and potentially a wider connector as well, thus requiring a larger "footprint" on the PCB. Moreover, wires of the upper level can interfere with seeing and/or accessing screw heads of the lower level.

Still other embodiments will become readily apparent to those skilled in this art from reading the above-recited detailed description and drawings of certain exemplary embodiments. It should be understood that numerous variations, modifications, and additional embodiments are possible, and accordingly, all such variations, modifications, and embodiments are to be regarded as being within the spirit and scope of this application. For example, regardless of the content of any portion (e.g., title, field, background, summary, abstract, drawing figure, etc.) of this application, unless clearly specified to the contrary, there is no requirement for the inclusion in any claim of any application claiming priority hereto of any particular described or illustrated activity or element, any particular sequence of such activities, or any particular interrelationship of such elements. Moreover, any activity can be repeated, any activity can be performed by multiple entities, and/or any element can be duplicated. Further, any activity or element can be excluded, the sequence of activities can vary, and/or the interrelationship of elements can vary. Accordingly, the descriptions and drawings are to be regarded as illustrative in nature, and not as restrictive. Moreover, when any number or range is described herein, unless clearly stated otherwise, that number or range is approximate. When any range is described herein, unless clearly stated otherwise, that range includes all values therein and all subranges therein. Any information in any material (e.g., a United States patent, United States patent application, book, article, etc.) that has been incorporated by reference herein, is only incorporated by reference to the extent that no conflict exists between such information and the other statements and drawings set forth herein. In the event of such conflict, including a conflict that would render any claim seeking priority hereto invalid, then any such conflicting information in such incorporated by reference material is specifically not incorporated by reference herein.

What is claimed is:

1. A system comprising:

a connector for electrically coupling a plurality of wires to a printed circuit board of a programmable logic controller, a termination end of each of the plurality of wires stripped of insulation, said connector comprising:

a housing defining a plurality of cages, said plurality of cages defining a co-planar plurality of cage openings; and a plurality of screw-actuated clamps, each of said screw-actuated clamps disposed substantially within a corresponding one of said plurality of cages, each of said screw-actuated clamps adapted to receive the stripped termination end of at least one of the plurality of wires via the corresponding cage opening, each of said screw-actuated clamps comprising an axially restrained screw, a movable clamping jaw coupled to said screw, and a stationary clamping jaw opposingly disposed to said movable clamping jaw;

wherein said plurality of screw-actuated clamps are disposed in an alternating proximal-distal relationship with respect to said co-planar plurality of cage openings.

2. The system of claim 1, wherein each axially restrained screw of said screw-actuated clamps is adapted to repeatedly transmit an applied torque of at least about 5 inch-pounds.

3. The system of claim 1, wherein at least a portion of each of said screw-actuated clamps is adapted to be moved with respect to its corresponding wire.

4. The system of claim 1, wherein each of said screw-actuated clamps is adapted to releasably clamp its corresponding wire.

5. The system of claim 1, wherein, for said plurality of screw-actuated clamps, a corresponding plurality of screw heads are disposed in an alternating proximal-distal relationship with respect to said co-planar plurality of cage openings.

6. The system of claim 1, further comprising a plurality of pins, each of which is electrically coupled to one of said plurality of screw-actuated clamps, and is adapted to be electrically coupled to the printed circuit board.

7. The system of claim 1, further comprising a plurality of pins, each of which is electrically coupled to one of said plurality of screw-actuated clamps and is adapted to be received in a socket of the printed circuit board.

8. The system of claim 1, wherein said connector is removably connectable to the printed circuit board.

9. The system of claim 1, wherein said connector is non-destructively removably connectable to the printed circuit board.

10. The system of claim 1, wherein each of said screw-actuated clamps is dimensioned to receive the stripped termination end of a plurality of sizes of wires.

11. The system of claim 1, wherein each of said screw-actuated clamps is dimensioned to receive a range of wire diameters spanning from approximately 22 gage to approximately 14 gage in diameter.

12. The system of claim 1, wherein each of said screw-actuated clamps is dimensioned to receive a range of wire diameters spanning upwards from a smallest diameter of approximately 22 gage.

13. The system of claim 1, wherein each of said screw-actuated clamps is dimensioned to receive a range of wire diameters spanning downward from a largest diameter of approximately 14 gage.

14. The system of claim 1, wherein each of said screw-actuated clamps is dimensioned to receive two wires having a diameter of approximately 14 gage.

15. The system of claim 1, wherein when said stripped termination ends of said plurality of wires are disposed within their corresponding cage openings, a screw head associated with each of said screw-actuated clamps is freely accessible to a screwdriver.

16. The system of claim 1, wherein an electrical path formed within said connector is adapted to repeatedly carry an electrical current of up to about 10 amps.

17. A method comprising:

for each of a plurality of wires, clamping a bare termination end of the wires within a screw-actuated clamp disposed substantially within a housing of a connector, the housing defining a plurality of coplanar openings via which the bare termination ends enter the housing, the plurality of screw-actuated clamps disposed in an alternating proximal-distal relationship with respect to the co-planar plurality of openings, each of said screw-actuated clamps comprising an axially restrained screw, a movable clamping jaw coupled to said screw, and a stationary clamping jaw opposingly disposed to said movable clamping jaw;

coupling the connector to a printed circuit board of a programmable logic controller.

18. The method of claim 17, further comprising:

releasing at least one of the plurality of wires from the corresponding screw-actuated clamp.

19. The method of claim 17, further comprising:

releasing at least one of the plurality of wires from the corresponding screw-actuated clamp.

20. The method of claim 17, further comprising:

clamping the bare termination ends of a plurality of wires within a selected screw-actuated clamp of the connector.

21. The method of claim 17, further comprising:

de-coupling the connector from the printed circuit board of the programmable logic controller.

22. The method of claim 17, further comprising:

nondestructively de-coupling the connector from the printed circuit board of the programmable logic controller.

* * * * *